United States Patent [19]

Noguchi et al.

[11] 4,099,508

[45] Jul. 11, 1978

[54] IGNITION SYSTEM

[75] Inventors: Yoshikazu Noguchi; Katsuyuki Senda; Mamoru Kobashi, all of Toyota, Japan

[73] Assignee: Toyota Jidosha Kogyo Kabushiki Kaisha, Japan

[21] Appl. No.: 688,465

[22] Filed: May 20, 1976

[30] Foreign Application Priority Data

Nov. 21, 1975 [JP] Japan ..... 50-158128[U]
Nov. 21, 1975 [JP] Japan ..... 50-158129[U]

[51] Int. Cl.[2] ..... F02P 3/04

[52] U.S. Cl. ..... 123/148 DC; 123/148 S; 315/224; 323/69; 361/106

[58] Field of Search ..... 123/148 D, 148 DC, 148 E, 123/148 AC, 198 R, 198 D, 198 DC, 119 F, 148 S, 146.5 D; 315/224; 317/9 B, 41, 14 H, 131; 323/68, 69; 338/22 R; 361/106, 1, 165, 37

[56] References Cited

U.S. PATENT DOCUMENTS

| | | | |
|---|---|---|---|
| 1,223,180 | 4/1917 | Kettering | 123/148 DC |
| 1,327,790 | 1/1920 | Taylor | 123/148 DC |
| 1,469,582 | 10/1923 | Buresch | 123/148 DC |
| 2,586,962 | 2/1952 | Kleis | 123/148 D |
| 3,025,455 | 3/1962 | Jonsson | 323/68 |
| 3,577,209 | 5/1971 | Perkins | 323/68 |
| 3,631,322 | 12/1971 | Kruger | 317/41 |
| 3,728,702 | 4/1973 | Miyamoto et al. | 317/41 |
| 3,836,340 | 9/1974 | Conwicke | 338/22 R |
| 4,054,940 | 10/1977 | Buchy et al. | 338/22 R |

*Primary Examiner*—Charles J. Myhre
*Assistant Examiner*—Andrew M. Dolinar
*Attorney, Agent, or Firm*—Koda and Androlia

[57] ABSTRACT

An ignition system for an internal combustion engine comprising a battery, an ignition coil having a primary and secondary winding, a variable impedance element whose impedance is temperature dependent coupled between the primary of the ignition coil and the battery, and a set of distributor points coupled between the primary and secondary windings of the ignition coil and ground. The variable impedance element prevents deterioration of the ignition efficiency as the temperature of the ignition coil goes up, and can also prevent the temperature of the ignition coil from raising to a point wherein the ignition coil is damaged.

5 Claims, 5 Drawing Figures

IGNITION SYSTEM

BACKGROUND OF THE INVENTION

1. Field of Invention

The present invention relates to ignition systems for internal combustion engines and more particularly to ignition systems capable of maintaining the efficiency of the ignition system at high temperatures and which are capable of controlling overheating of the ignition coil.

2. Prior Art

In the ignition system of an automobile, the voltage generated in the secondary winding of the ignition coil is proportional to the primary current $I_1$ which flows continually in the primary side of the ignition coil. The primary current $I_1$ is affected by several external factors. The following are among such external factors which particularly influence the lowering of the primary current $I_1$:

(1) an increase in the number of engine revolutions *n;*

(2) an increase in the primary resistance of the ignition coil as a result of a rise in the temperature of the ignition coil; and (3) a decrease in the voltage of the battery.

In order to improve the conditions mentioned in (1) and (2) above, generally an external resistor is inserted in series with the primary winding of the ignition coil. Such a circuit is shown in FIG. 1. In FIG. 1, electric current from battery 1 is supplied via external resistor 2 to the primary winding 3*a* of ignition coil 3. The primary winding 3*a* and the secondary winding 3*b* of the ignition coil 3 are coupled to each other at one end. Between the junction formed by one end of the primary winding 3*a* and one end of secondary winding 3*b* and ground is inserted an interrupter 4, such as a set of distributor points, and a condenser 5 coupled together in parallel. The interrupter 4 interrupts the current flowing ignition coil 3 in response to the speed of rotation of the engine. Interruption of the current by interrupter 4 causes high voltage to be generated in the secondary coil 3*b* of ignition coil 3. The aforementioned condenser 5 is employed to absorb the electric arc that is produced at both ends of the interruption of the current through primary winding 3*a* of ignition coil 3.

Four ignition spark plugs 6*a*–6*d* are coupled to the secondary coil winding 3*b* of ignition coil 3. The high voltage from secondary coil 3*b* is selectively applied to these ignition plugs 6*a*–6*d* by a distributor (not shown).

The value of external resistor 2 is set substantially equal to the direct current resistance $R_1$ of the primary winding 3*a* of ignition coil 3. Thus, the primary resistance, as seen from the battery side, is apportioned approximately half to the direct current resistance $R_1$ of the primary winding of ignition coil 3 and half to the value of the resistance of external resistor 2. For this reason, the Joule's heat that is generated in ignition coil 3 is cut in half. In other words, if the Joule's heat generated by the current flowing through ignition coil 3 could be withstood without an external resistor 2, it would be possible to increase the primary current in ignition coil 3.

In order to generate in the secondary winding 3*b* of ignition coil 3 the same high voltage as was produced without the external resistor 2, the number of windings of primary winding 3*a* must be decreased by prescribed number, but the direct current resistance of the primary coil 3*a* must be set such that it will have a resistance value equivalent to the resistance value of the external resistor 2. In this way, even if the temperature of ignition coil 3 rises, it is possible to minimize the decrease of the high voltage that is generated in the secondary winding 3*b*.

In some applications, the circuit structure described hereinabove is not necessarily a fixed circuit. For example, since at the time of starting an engine a greater amount of current is required than the current required during normal operation, a means for shorting the external resistor is provided. Accordingly, whenever a greater current is needed, such means is actuated to short the external resistor 2. However, this method of increasing current has several drawbacks. First of all, at high temperatures (over 80° C), the direct current resistance value of the primary winding 3*a* increases resulting in a deterioration of the ignition efficiency. Furthermore, if the ignition key switch is left in the on position while the engine is stopped, the external resistor 2 is shorted and the primary current in the ignition coil 3 continues to flow such that the temperature of ignition coil 3 rises abnormally resulting in a failure of the ignition coil.

BRIEF SUMMARY OF THE INVENTION

Accordingly it is a general object of the present invention to provide an ignition system whose efficiency at high temperatures does not deteriorate thereby increasing the primary current available in the ignition coil .

It is another object of the present invention to provide an ignition system which prevents the temperature of the ignition coil from rising above some pedetermined point causing damage to the ignition coil.

It is still another object of the present invention to provide a ignition system of improved efficiency.

In keeping with the principles of the present invention, the objects are accomplished in one embodiment by the unique combination of a battery, an ignition coil having a primary and secondary windings, a variable impedance element whose impedance is temperature dependent coupled between the primary winding of the ignition coil and the battery, and a set of distributor points coupled between the primary and secondary winding of the ignition coil and ground. The variable impedance element is of the type with a negative temperature coefficient and having a two value characteristic, i.e., a high resistance value at low temperatures and a low resistance value at high temperatures. Accordingly, such a variable impedance element prevents deterioration of ignition efficiency as the temperature of the ignition coil goes up.

In a second embodiment a second impedance element is put in series with the first variable impedance element. The second impedance element is of the type having a positive temperature coefficient ahd having a two value characteristic, i.e., a low resistance value at low temperatures and a high resistance value at high temperatures. This second variable impedance element prevents damage to the ignition coil in the event the temperature of the ignition coil reaches a very high temperature.

BRIEF DESCRIPTION OF THE DRAWINGS

The above mentioned and other features and objects of the present invention will become more apparent by reference to the following description taken in conjunction with the accompanying drawings, wherein like reference numerals denote like elements, and in which.

DETAILED DESCRIPTION OF THE INVENTION

Figure 1:
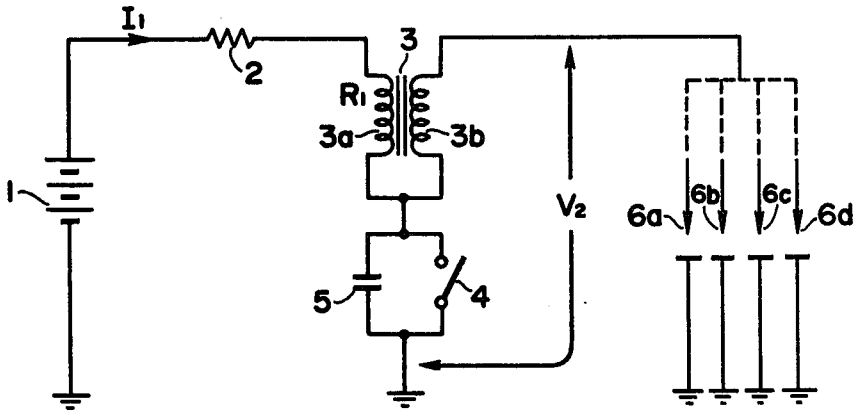
FIG. 1 PRIOR ART
FIG. 1 is a circuit diagram of an ignition system of the prior art.
Figure 2:
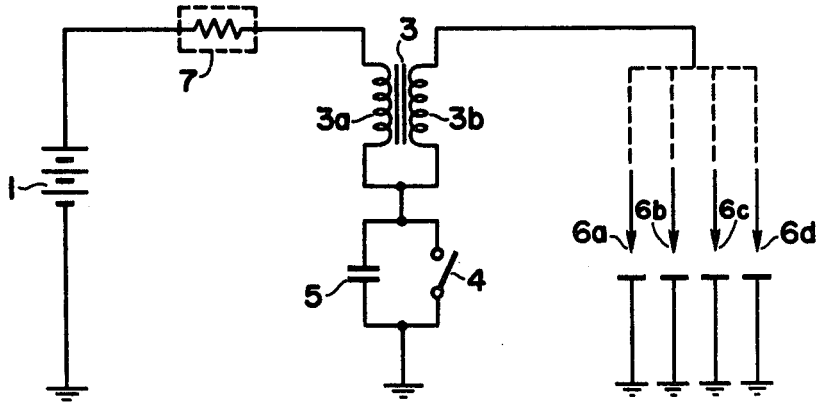
FIG. 2 is a circuit diagram of one embodiment of the ignition system in accordance with the teachings of the present invention.

Referring to FIG. 2, shown therein is a circuit diagram of one embodiment of the present invention. The ignition system of FIG. 2 comprises a battery 1, an ignition coil 3, an interrupter 4, a condenser 5 and a thermister 7. The present embodiment is distinguished from the prior art in that the external resistor 2 has been replaced by thermister 7 having specific characteristics described hereinbelow.

The ignition coil 3 comprises a primary winding 3*a* and a secondary winding 3*b*. Intermittent flow of current in the primary winding 3*a* causes high voltage to be generated in secondary winding 3*b*. The high voltage thus generated in secondary coil 3*b* is applied to a plurality of ignition plugs 6*a*–6*d*. In a four cylinder engine, four such ignition plugs are used. In a two cylinder engine, two ignition plugs are used. In the present embodiment, the number of plugs is independent of the invention and four plugs are used.

Electric current from battery 1 is supplied via thermister 2, as an impedance element, to the primary winding 3*a* of ignition coil 3. The primary winding 3*a* and the secondary winding 3*b* are coupled together at one end thereof. An interrupter 4 is inserted between the junction formed by one end of primary winding 3*a* and one end of secondary winding 3*b* and the other end of battery 1. Interrupter 4 is typically a set of distributor points. The intermittent flow of current in primary winding 3*a* caused by interrupter 4 causes a high voltage to be generated in the secondary winding 3*b* of ignition coil 3. The condenser 5 is coupled to interrupter 4 in parallel configuration. The condenser 5 is used to absorb the arc that is produced when the primary current in ignition coil 3 is interrupted.

Figure 3:
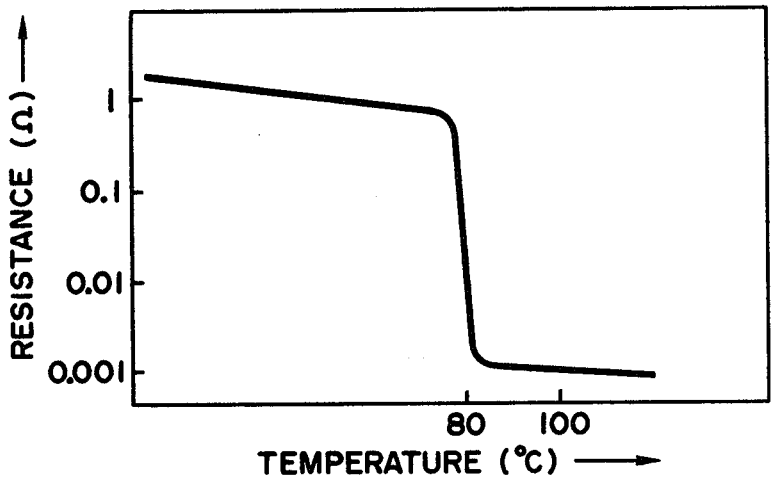
FIG. 3 is a graph showing the relationship between temperature and resistance characteristics of the thermister used in the embodiment of FIG. 1.

As shown in FIG. 3, thermister 7 is a negative temperature coefficient thermister (NTC) with a temperature resistance characteristic of substantially two values, i.e., high resistance at low temperatures, and low resistance at high temperatures. Typically this type of thermister 7 is made up of a vanadium oxide such as for example, vanadium dioxide ($VO_2$). In the presently preferred embodiment, the thermister has a low/high temperature ratio of greater than one thousand. In other words at temperatures below some predetermined value, such as 80° C, the resistance is approximately 1 ohm; but when the temperature exceeds this predetermined temperature, the resistance drops down to approximately 0.001 ohms, all as shown in FIG. 3. In the ignition system of FIG. 2, at about 80°which is the normal temperature of operation for ignition coil 3, the value of the resistance of primary winding 3*a* increases while the value of the resistance of thermister 7 decreases. Accordingly, the primary current in primary winding 3*a* can be essentially increased, not only because the current does not decrease at high temperature, but also because the variation in the resistance of the primary coil 3*a* is minimal when compared with the variation in the resistance of thermister 7. Accordingly, the voltage in secondary winding 3*b* is not lowered at high temperatures thereby improving ignition efficiency. In this case, as the primary current increases, Joule's heat that is produced in ignition coil 3 increases. However, it is possible to cope with this additional heat in this situation by giving proper consideration to appropriate winding and heat radiating methods.

As described hereinabove the present invention improves ignition efficiency by increasing the primary current of the ignition coil at high temperatures thereby raising the high voltage which is generated in the secondary winding 3*b*.

Figure 4:
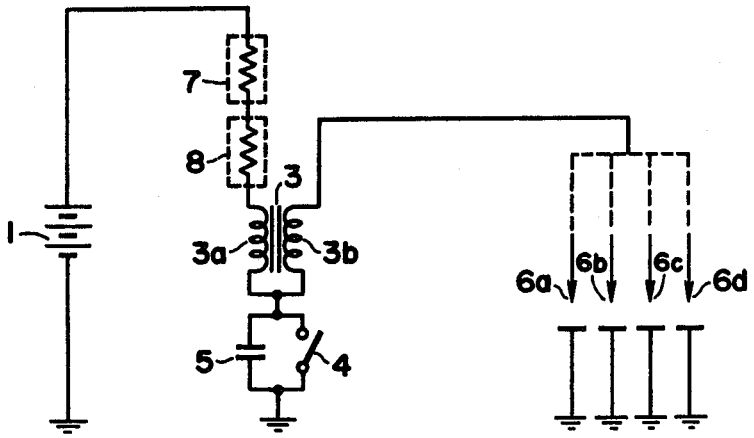
FIG. 4 is a second embodiment of an ignition system in accordance with the teachings of the present invention.

In additon to improving the ignition efficiency of the ignition system, in FIG. 4 is shown a second embodiment of the present invention which means to prevent abnormal overheating of the ignition coil at high temperatures.

Referring to FIG. 4, shown therein is an ignition system substantially the same as shown in FIG. 3 except that a second thermister 8 is inserted in series with thermister 7. Since the remainder of the structure is substantially identical to that shown in FIG. 3, it will not be described herein and with respect to those members of FIG. 4 which are identical to those in FIG. 3, like reference numerals are used.

Thermister 8 is a positive temperature coefficient thermister (PTC). Thermister 8 is also a thermister of the type which has substantially only two values except that thermister 8 is a low value at low temperatures and a high value at high temperatures.

Figure 5:
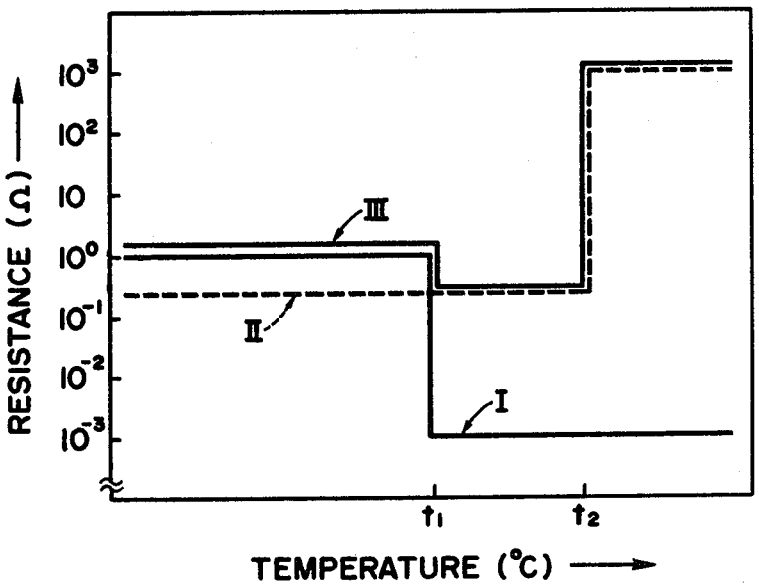
FIG. 5 is a graph showing the relationship between the temperature and resistance characteristics of both of the thermisters used in the embodiment of FIG. 4.

FIG. 5 shows the temperature resistance relationship of thermister 7 and 8. The symbol I denotes the characteristics of thermister 7 and the symbol II denotes those of thermister 8. The symbol III denotes the combined characteristics of thermisters 7 and 8. As shown in FIG. 5, thermister 7 is set so as to have a low resistance value after reaching a temperature $t_1$, typically $t_1$ is about 80° C. Thermister 8, on the other hand, is set so as to have a high resistance value after reaching a temperature $t_2$, typically about 120° C (a temperature just under the failure point of the ignition coil 3).

In operation, when the temperature rises beyond temperature $t_1$ the resistance in series with a primary winding 3*a* of ignition coil 3 decreases and the primary current in primary winding 3*a* increases thereby improving ignition efficiency at high temperatures. Moreover, in cases where the primary current in the primary winding 3*a* of ignition coil 3 is left flowing, the resistance in series with the primary winding 3*a* of ignition coil 3 increases when the temperature of ignition coil 3 reaches temperature $t_2$ thereby substantially reducing the current flowing in coil 3 and preventing damage to ignition coil 3 by increased temperatures.

As clearly seen from the above discussion, the present invention improves the ignition efficiency by increasing the primary current in ignition coil 3 at high temperatures thereby increasing the high voltage that is generated in secondary coil 3*b*. Moreover, the present invention decreases the primary current after some predetermined temperature is reached or exceeded thereby preventing overheating of the ignition coil which can result in ignition coil failure.

In all cases it is understood that the above described embodiments are merely illustrative of but a small number of the many possible specific embodiments which represent the applications and principals of the present invention. Furthermore, numerous and varied other arrangments can be readily devised in accordance with these principals by those skilled in the art without departing from the spirit and scope of the invention.

we claim:

1. An ignition system for an internal combustion engine comprising:

a source of direct current power;

an ignition coil having primary and secondary windings;

a first impedance element whose impedance is temperature dependent, said first impedance element being coupled between said source of direct current power and said primary winding of said ignition coil and comprising a negative temperature coefficient thermistor having a two value temperature coefficient characteristic such that below some predetermined temperature it is a high resistance and above some predetermined temperature it is a low resistance whereby the primary current flowing through said primary winding of said ignition coil is not decreased as the direct current resistance of the ignition coil increases with temperature; and a second impedance element whose impedance is temperature dependent, said second impedance element comprising a positive temperature coefficient thermistor having a two value characteristic such that below a second predetermined temperature it is a low resistance and above said second predetermined temperature it is a high resistance, and wherein the combination of said first impedance element and said second impedance element produces a three value temperature coefficient characteristic.

2. An ignition system according to claim 1 wherein said three valve temperature coefficient characteristic has an initially high resistance until some predetermined temperature ($t_1$) is reached, a low resistance after reaching said predetermined temperature ($t_1$), and a high resistance after a higher predetermined temperature ($t_2$) is reached.

3. An ignition system according to claim 2 wherein $t_1 = 80°$ C and $t_2 = 120°$ C.

4. An ignition system according to claim 1 further comprising a set of distributor points coupled between said primary and secondary windings of said ignition coil and a battery whereby a high voltage is generated in said secondary winding whenever the primary current in said primary winding of said ignition coil is interrupted by said distributor points.

5. An ignition system according to claim 4 further comprising a plurality of ignition plugs coupled to said secondary winding of said ignition coil.

* * * * *